US011479278B2

(12) United States Patent
Schneider et al.

(10) Patent No.: US 11,479,278 B2
(45) Date of Patent: Oct. 25, 2022

(54) EARTHING CONTACT AND METHOD FOR DISSIPATING ELECTRIC CURRENTS

(71) Applicant: SCHUNK TRANSIT SYSTEMS GMBH, Wettenberg (DE)

(72) Inventors: Lothar Schneider, Lahnau (DE); Annette Schneider, Fronhausen (DE)

(73) Assignee: SCHUNK TRANSIT SYSTEMS GMBH, Wettenberg (DE)

( * ) Notice: Subject to any disclaimer, the term of this patent is extended or adjusted under 35 U.S.C. 154(b) by 0 days.

(21) Appl. No.: 17/255,011

(22) PCT Filed: May 6, 2019

(86) PCT No.: PCT/EP2019/061594
§ 371 (c)(1),
(2) Date: Dec. 22, 2020

(87) PCT Pub. No.: WO2020/224762
PCT Pub. Date: Nov. 12, 2020

(65) Prior Publication Data
US 2022/0048545 A1 Feb. 17, 2022

(51) Int. Cl.
*B61F 15/20* (2006.01)
*H01R 39/20* (2006.01)
(Continued)

(52) U.S. Cl.
CPC ..... *B61F 15/20* (2013.01); *H01R 39/20* (2013.01); *H01R 39/26* (2013.01); *H01R 39/64* (2013.01); *H01R 2201/26* (2013.01)

(58) Field of Classification Search
CPC ..... H01R 39/20; H01R 39/26; B61F 15/20
See application file for complete search history.

(56) References Cited

U.S. PATENT DOCUMENTS 9,496,669 B2 * 11/2016 Pichler ..... H01R 39/24
2012/0326081 A1 * 12/2012 Kagawa ..... H01R 39/20 252/182.32
2019/0199180 A1 * 6/2019 Huber ..... H01R 39/381

FOREIGN PATENT DOCUMENTS

DE 102010039847 A1 3/2012
EP 0168676 A2 1/1986
WO 2018019725 A1 2/2018

OTHER PUBLICATIONS

Mersen, available at https://web.archive.org/web/20170701214951/http://ep-us.mersen.com/fileadmin/catalog/Products/Power-Transfer-for-Rail-Vehicles/Earthing-Current-Units-ERCU/Earthing-contacts-for-Metro-and-Tram/2-Gaines-Standard-Radial-20X25-250Amp/DS-2-Gaines-standard-Radial-20X25-250Amp-EN.pdf (Year: 2017).*
(Continued)

*Primary Examiner* — Oscar C Jimenez
*Assistant Examiner* — Paul D Baillargeon
(74) *Attorney, Agent, or Firm* — Quarles & Brady LLP; Yakov Sidorin

(57) ABSTRACT

The invention relates to a ground terminal and to a method for discharging electric currents from a rotor part of a vehicle (such as a rail vehicle or the like, that has an axle) to a stationary stator part of the vehicle. The ground terminal includes a retaining device and a terminal element. The retaining device is connected to the stationary stator part of the vehicle in electrically-conductive manner, the terminal element is disposed on and connected to the retaining in electrically-conductive manner. The terminal element is made mostly of graphite and subjected to a contact force by means of a spring device of the retaining device to realize an electrically-conductive sliding contact between a sliding contact surface of the terminal element provided for realizing the sliding contact and a terminal surface of the rotor part. The terminal element has an arc-shaped cross-section at
(Continued)

least in portions thereof, an outer surface of the cross-section forming the sliding contact surface at least in sections. The sliding contact surface abuts radially against the terminal surface of the rotor part.

18 Claims, 2 Drawing Sheets

(51) Int. Cl.
*H01R 39/26* (2006.01)
*H01R 39/64* (2006.01)

(56) References Cited

OTHER PUBLICATIONS

English Language Translation of the International Preliminary Report on Patentability, PCT/EP2019/061594, dated Nov. 18, 2021, 8 pages.
PCT Search Report and Written Opinion dated Jan. 27, 2020 in connection with PCT/EP2019/061594.

* cited by examiner

EARTHING CONTACT AND METHOD FOR DISSIPATING ELECTRIC CURRENTS

CROSS-REFERENCE TO RELATED APPLICATIONS

This application is a continuation from the international patent application PCT/EP2019/061594 filed on May 6, 2019 and now published as WO 2020/2247762. The disclosure of the above-identified international patent application is incorporated by reference herein.

RELATED ART

The invention relates to a ground terminal and a method for discharging electric currents from a rotor part of a vehicle, in particular a rail vehicle or the like, having an axle to a stationary stator part of the vehicle, the ground terminal comprising a retaining device and a terminal element, the retaining device being connected to the stationary stator part of the vehicle in an electrically conductive manner, the terminal element being disposed on the retaining device and being connected thereto in an electrically conductive manner, the terminal element being made mostly (that is, in excess of fifty percent) of graphite, the terminal element being subjected to a contact force by means of a spring device of the retaining device in order to realize an electrically conductive sliding contact between a sliding contact surface of the terminal element provided for realizing the sliding contact and a terminal surface of the rotor part.

Ground terminals are commonly used on axles of rail vehicles, in particular electrically driven rail vehicles. They serve to transmit electrical currents to a rail via an axle of a bogie. The known ground terminals are commonly disposed on an axle on an axial side of the axle and connected to an axle support of the rail vehicle in a torque-proof manner or rotatably connected thereto in relation to the axial side. The ground terminals comprise a casing having a flange-like casing lid, or casing cover, disposed on the axial side, terminal pieces made of graphite being contacted with the axle or corresponding slip rings—or slip plates—within the casing for transmitting a current. Such a ground terminal having terminal elements made of graphite and abutting against an axial end is disclosed in DE 10 2010 039 847 A1, for example.

A sliding contact surface of a sliding contact between the terminal element or terminal elements and a terminal surface on the axle has to be comparatively large in order to be able to transmit or continuously discharge large currents of up to 250 A via the ground terminal. This results in the disadvantage of a comparatively large installation space on an end on the side of the respective axle for the ground terminal.

The object of the invention at hand is therefore to propose a ground terminal and a method for discharging electric currents from a rotor part of a vehicle which has an axle and a space-saving ground terminal.

This object is attained by a ground terminal having the features of claim 1, a rail vehicle having the features of claim 18, and a method having the features of claim 19.

SUMMARY OF THE INVENTION

The ground terminal according to the invention for discharging electric currents from a rotor part of a vehicle, in particular a rail vehicle or the like, having an axle to a stationary stator part of the vehicle comprises a retaining device and a terminal element, the retaining device being connected to the stationary stator part of the vehicle in an electrically conductive manner, the terminal element being disposed on the retaining device and being connected thereto in an electrically conductive manner, the terminal element being made mostly of graphite, the terminal element being able to be subjected to a contact force by means of a spring device of the retaining device in order to realize an electrically conductive sliding contact between a sliding contact surface of the terminal element provided for realizing the sliding contact and a terminal surface of the rotor part, the terminal element having an arc-shaped or circular-ring-shaped cross section at least in portions of the terminal element, an outer surface of the cross section forming the sliding contact surface at least in sections or portions thereof, the sliding contact surface being realized to abut radially against the terminal surface of the rotor part.

According to the invention, the terminal element of the ground terminal is realized such that the cross section is arc-shaped or circular-ring-shaped in the axial direction of the rotor part or the axle of the vehicle with respect to the cross section of the terminal element. A radial outer surface of the cross section or the terminal element can form the sliding contact surface since the radial outer surface can abut against a radial inner surface of the rotor part or the axle. Accordingly, it becomes possible to dispose the ground terminal at least partially within an axial end of the axle. In contrast to a position on a radial outer surface or an axial front face on the axial end of the axle, an installation space of the ground terminal can thus be substantially reduced. Nevertheless it is still possible to realize a sufficiently large sliding contact surface for continuously transmitting large currents.

Consequently, the rotor piece can form an annular cross section on an axial end of the axle, the radial inner surface of the annular cross section being able to form the terminal surface at least in partly. It can also be intended that the terminal element is entirely inserted into the axial end of the axle. The terminal element can then be connected to an axle support of the vehicle via the retaining device in a torque-proof manner.

Furthermore, the inner surface can be formed by a recess on the axial end of the axle. The recess can be realized like a cylindric bore in a front face of the axial end of the axle. Since the axial end of the axle is exposed to only small static loads, the recess can be realized in the axial end without impacting a sturdiness of the axle. The recess can be realized so deep that the ground terminal can be inserted into the recess to a large extent, preferably nearly entirely. The radial inner surface of the recess can then be easily used for abutting against a radial outer surface of the terminal element. Realizing a particularly large sliding contact surface also becomes possible by the terminal element and the recess being able to be realized comparatively large and deep, respectively, in an axial direction of the axle. The inner surface of the recess can be realized having little surface roughness so that the terminal element can abut directly against the inner surface without the terminal element being exposed to much wear.

Alternatively, the inner surface can be realized by a sleeve of the ground terminal, the sleeve being able to pressed into a recess on the axial end of the axle. It is then possible to produce the recess on the axial end of the axle more easily, without a surface of the inner surface of the axle having to be realized having a particular roughness. A press fit can be realized between the sleeve of the ground terminal and the recess in the axial end so that the sleeve can be easily fastened in the recess by being pressed in. Since only very little torque is transferred via the sleeve, realizing a minimal press fit suffices for fastening the sleeve. The inner surface of the sleeve can be realized having a surface roughness suitable for abutting against the terminal element. Furthermore, an installation space of the ground terminal is not further enlarged by the sleeve since a wall of the sleeve can be comparatively thin. At the same time, it is also possible to realize the ground terminal as a cohesive component group whereby mounting the ground terminal on the axial end of the axle can be substantially facilitated.

The axle can also be realized as a hollow shaft so that it is not necessarily required to realize a recess within the axle solely for the purpose of accommodating the ground terminal.

The retaining device can comprise a stationary base body. The base body can be used for being connected to an axle support in a torque-proof manner and for disposing the terminal element. At the same time, a current can be easily transmitted via the base body. Preferably, the base body can therefore be made of an electrically conductive metal. The terminal element can be made or consist of graphite. The terminal element can be fastened on a terminal element accommodation of the retaining device realized on the base body. The base body can, for instance, be realized having a recess into which the terminal element is inserted. The retaining device can comprise a guiding device for movably guiding the terminal element on the terminal element accommodation in the radial direction. It can be also be intended that a groove is realized on the base body which extends transversally or perpendicular to the rotational axis of the axle. The groove can be large enough that the terminal element abuts against lateral surfaces of the groove and is thus fixated on the base body in at least one possible direction of movement. The groove in the retaining device forms the guiding device.

The terminal element accommodation can form a guide groove which extends radially on the base body and in which a guide pin disposed on the terminal element or a protrusion formed on the terminal element can engage. The guide groove extending radially on the base body enables guiding the guide pin within the guide groove in such a manner that the terminal element can only be moved in the radial direction with respect to an inner surface of the axle. A contact force can then be exerted on the terminal element via the spring device, the contact force acting on the terminal surface in the radial direction. This thus ensures a sufficiently large sliding contact surface, without the terminal element becoming tilted or displaced. A bore can be formed within the terminal element into which the guide pin is inserted. It is possible to alternatively realize a protrusion on the terminal element, e.g., by machining the terminal element, the protrusion being guided in the guide groove. It is further conceivable for the guide groove to be realized or disposed in the terminal element and the protrusion or guide pin to be realized or disposed on the base body.

The ground terminal can comprise at least two terminal elements which are disposed coaxially on the base body relative to a rotational axis of the axle. This is particularly advantageous as the base body is sandwiched between the two terminal elements. This leads to the base body being centered and simultaneously to an even wear of the opposing terminal elements. It is generally possible to dispose three, four, five or more terminal elements accordingly on the base body. This results in a particularly large sliding contact surface for transmitting electric currents. The spring device can then also be realized in such a manner that an even pressure force or contact force is realized for all terminal elements.

The retaining device can form a connection device for connecting the retaining device and the terminal device in an electrically conductive manner, the connection device being able to be realized by a protrusion of the base body and can comprise a connecting element by means of which at least one strand fastened to the terminal element can be fastened to the protrusion. For instance, a bore having a thread can be realized in the protrusion of the base body, a screw being inserted into the bore. Furthermore, the screw can also be fastened to the protrusion at a through bore using a nut. The screw forms the connecting element by means of which the strand is clamped to the protrusion or can be contacted electrically. A terminal lug can be fastened to the strand so that the terminal lug is fastened to the protrusion with the connecting element. It is further conceivable to forgo the connecting element and to fasten the strand to the protrusion in an integral manner, e.g., by soldering. The strand itself can be fastened to the terminal element in a known manner; for instance, by being inserted and fastened in a bore on the terminal element or by being soldered to the terminal element. Since it is intended to transmit large currents, several strands, for instance two strands, can be fastened to the terminal element. A corresponding number of connecting elements can then be provided on the base body.

The protrusion can form a distal end of the base body disposable within a recess on an axial end of the axle. The protrusion can therefore extend far into to the recess on the axial end of the axle. There is also enough space available for disposing the strands and the connecting elements within the recess. Since the recess does not serve for being contacted with a terminal element in this area, an inner diameter of the recess can be smaller in this instance and a surface of an inner surface of the recess can be of any quality.

The retaining device can have a bearing device for rotatably bearing the base body on a radial inner surface of the rotor part, the bearing device being able to comprise a rolling bearing or a sliding bearing. The rolling bearing or the sliding bearing can be disposed on the radial inner surface of the rotor part within the terminal surface. The base body can be fastened within the rolling bearing or sliding bearing so that the rolling bearing or sliding bearing retains the base body in the direction of a rotational axis of the axle in a torque-proof manner and positions the base body relative to the rotational axis and/or to the rotor part. The rolling bearing or the sliding bearing can directly abut against an inner surface of the axle or against an inner surface of a sleeve of the ground terminal.

The bearing device can comprise a sealing disc which encircles the base body in sections, can be connected to an axial end of the axle and can seal a recess, which at least partially receives the base body, on the axial end. The sealing disc can be arc-shaped and encircle the base body coaxially. Furthermore, the sealing disc can be connected to the axial end of the axle, e.g., by screws, so that the sealing disc is rotatable in conjunction with the axle and/or the rotor part, the base body then being torque-proof. The sealing disc can completely seal the recess forming the axial end of the axle and seal it against detrimental environmental influences, such as humidity or dirt. The base body, which passes through a central bore in the sealing disc, can be sealed at the sealing disc by means of another disc, which is fastened to the sealing disc or the base body. The further seal can be an O-ring or a radial shaft seal.

The bearing device can comprise a torque support by means of which the base body can be fastened to the stationary stator part. The torque support can prevent the base body from rotating with the axle and retain it at an axle support of the rail vehicle in a torque-proof manner. Consequently, the torque support can be tightly connected to the axle support of the rail vehicle.

The torque support can be a bar which can be fastened to the base body in a torque-proof manner and via which the base body can be connected to the stator part in an electrically conductive manner. The bar can therefore be made of an electrically conductive metal and be screwed to an axial end of the base body, for example. A screw can be inserted eccentrically in the axial end of the base body relative to a rotational axis of the axle. Alternatively or additionally thereto, the bar can be connected to the axial end of the base body in a form-fit manner. Owing to the bar and the base body being directly connected, it becomes possible to discharge an electric current from the base body to the axle support of the rail vehicle directly via the bar.

The base body can comprise a spring element, preferably a coil spring, a pressure spring, a leaf spring, a helical spring, or a diaphragm spring, the spring element being able to be disposed on a pressurizing side of the terminal element facing away from the sliding contact surface. The spring element can be consequently sandwiched between a base element for retaining the terminal element and the terminal element so that the terminal element can be pressed against an inner surface of the rotor part using a contact force in a radial direction relative to a rotational axis of the axle. If the spring element is a pressure spring, for example, the pressure spring can be simply inserted into a bore realized in the terminal element. Mounting the terminal element having the pressure spring is substantially facilitated. Furthermore, a plurality of spring elements can be used for realizing the spring device, e.g., by disposing four pressure springs on the terminal element when a sufficiently large and evenly distributed contact force is to be applied. Provided that two terminal elements are disposed coaxially relative to the rotational axis, the spring device can be realized between these two terminal elements, i.e., the spring device can exert a contact force on both terminal elements simultaneously. As a result, the spring device can be sandwiched between the terminal elements. A smaller number of spring elements is then required.

The rail vehicle according to the invention comprises a ground terminal according to the invention for discharging electric currents from a rotor part having an axle to a stationary stator part of the rail vehicle. Further advantageous embodiments of a rail vehicle can be derived from the description of features of the dependent claims referring back to device claim 1.

In the method according to the invention, electric currents are discharged from a rotor part of a vehicle, in particular a rail vehicle or the like, having an axle to a stationary stator part of the vehicle, a retaining device of a ground terminal being connected to the stationary stator part of the vehicle in an electrically conductive manner, a terminal element of the ground terminal made mostly (that is, in excess of fifty percent) of carbon being disposed on the retaining device and being connected thereto in an electrically conductive manner, the terminal element being subjected to a contact force by means of a spring device of the retaining device in order to realize an electrically conductive sliding contact between a sliding contact surface of the terminal element provided for realizing the sliding contact and a terminal surface of the rotor part, the terminal element having an arc-shaped/circular-ring-shaped cross section at least in parts of the terminal element, the sliding contact surface being realized by an outer surface of the cross section at least in sections to radially abut against the terminal surface of the rotor part.

In particular, a current of at least 100 A, preferably 250 A, can be continuously discharged from the rotor part to the stator part of the vehicle via the ground terminal.

Further advantageous embodiments of the method can be derived from the description of features of the dependent claims referring back to device claim 1.

BRIEF DESCRIPTION OF THE DRAWINGS

In the following, the invention is described in more detail by means of the drawing.

FIG. 1 shows a cut view of a ground terminal 10 having two terminal elements 11, terminal elements 11 being illustrated in more detail in FIG. 2 to FIG. 5. Ground terminal 10 serves for discharging electric currents from an axle (not further illustrated) of a vehicle or rather rail vehicle. Ground terminal 10 comprises a retaining device 12 for retaining terminal elements 11 of ground terminal 10, terminal elements 11 and retaining device 12 essentially being part of a stator part 13 of the vehicle (not further illustrated). Ground terminal 10 further comprises a sleeve 14 and a sealing disc 15 as part of a bearing device 16 of ground terminal 10 which are both connected to an axial end (not illustrated) of the axle and can thus be associated to a rotor part 17 of the vehicle. Sleeve 14 is pressed into a recess (not illustrated) on the axial end of the axle. Sealing disc 15 is tightly connected to sleeve 14 and/or the axle via indicated screws 18. Sleeve 14 has an inner surface 19 which realizes a terminal surface 20 of rotor part 17. Terminal elements 11 comprise a sliding contact surface 21 for abutting against terminal surface 20 so that an electrically conductive sliding contact 22 is formed between respective terminal element 11 and inner surface 19.

Figure 1:
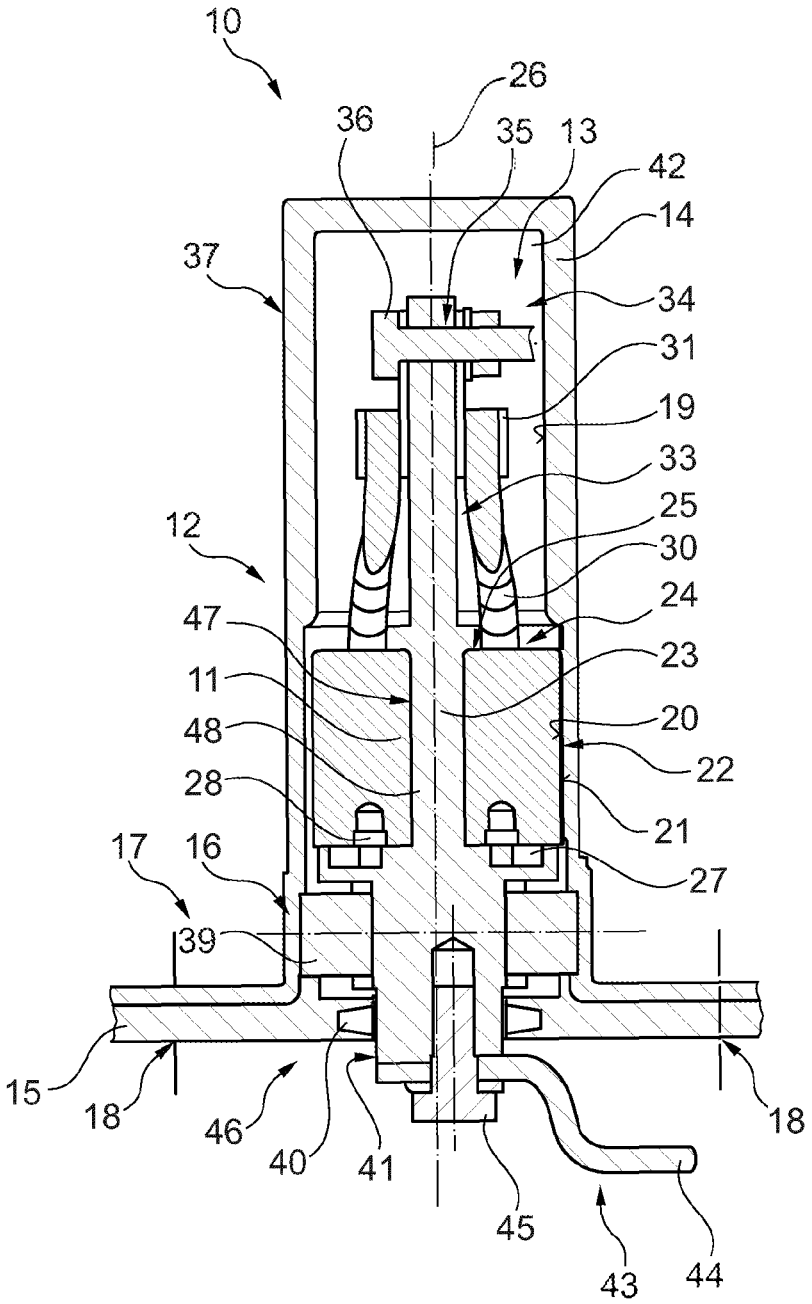
FIG. 1 shows a longitudinal cut of a ground terminal.
Figure 2:
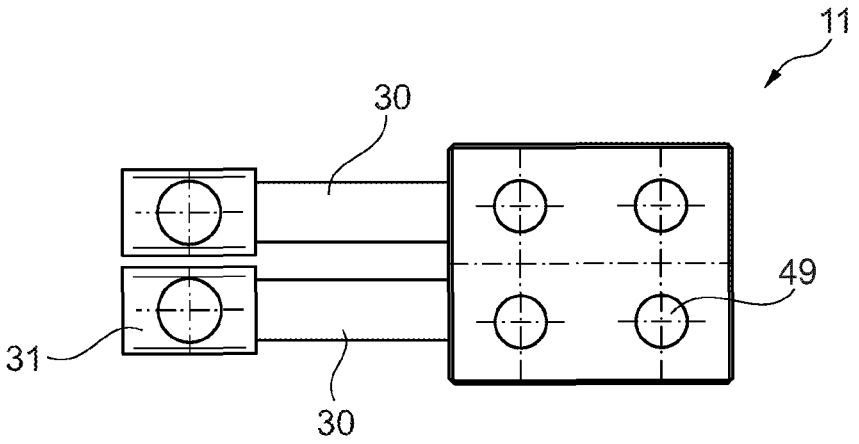
FIG. 2 shows a view from below of a terminal element.
Figure 3:
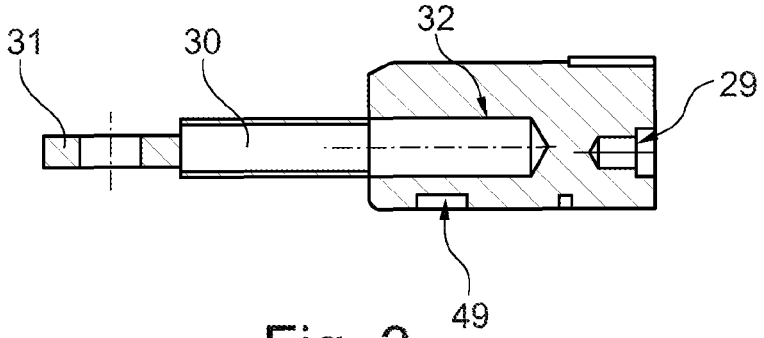
FIG. 3 shows a cut view of the terminal element from FIG. 4 along a line III-III.
Figure 4:
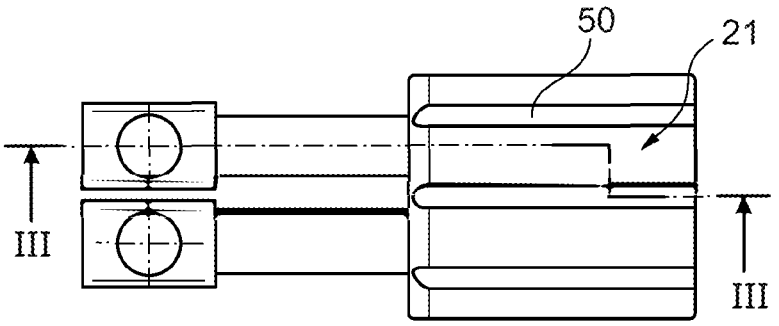
FIG. 4 shows a top view of the terminal element.
Figure 5:
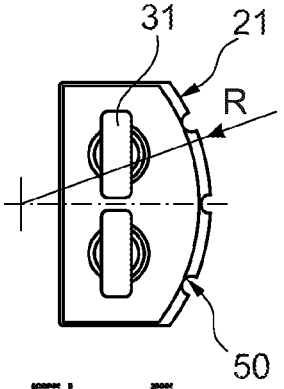
FIG. 5 shows a back view of the terminal element.

Retaining device 12 comprises a base body 23 which is made of electrically conductive metal and forms a terminal element accommodation 24 for each terminal element 11. Terminal element accommodation 24 protects terminal element 11 from an axial displacement and forms a guiding device 25 for movably guiding terminal element 11 in a radial direction relative to a rotational axis 26. Guiding device 25 is realized on base body 23 by a guiding groove 27 and a guiding pin 28, which is inserted into a bore 29 in terminal element 11.

Furthermore, two strands 30 are fastened to each terminal element 11 by means of cable lugs 31. Strand 30 is inserted into a bore 32 in terminal element 11 and fastened or affixed there by means of tamping powder. A protrusion 33 is integrally formed on base body 23 and a through bore 35 is formed on a distal end 34 of protrusion 33. Cable lugs 31 are tightly fastened to distal end 34 of protrusion 33 by means of a screw connection 36. An electrically conductive connection is produced between terminal ends 11 and base body 23 by a connecting device 37 realized such.

Retaining device 12 comprises bearing device 16 for rotatably bearing base body 23 on radial inner surface 19, bearing device 16 comprising a rolling bearing 39. Bearing device 16 further comprises sealing disc 16 having a seal 40. Base body 23 is passed through sealing disc 15 and seal 40 closely abuts against a diameter 41 of base body 23. It is thus prevented that dirt and humidity can enter an inner space 42 of sleeve 14.

Bearing device 16 further comprises a torque support 43 made of a bar 44. Bar 44 is fastened to an axial end 46 of base body 23 by means of a screw 45. Screw 45 is disposed eccentrically relative to rotational axis 26. An electric connection from base body 23 to an axle support of the rail vehicle can thus be easily produced via bar 44.

To realize a contact force of respective terminal element 11 on inner surface 19, retaining device 12 comprises a spring device 47. Spring device 47 comprises a number of pressure springs 48 which are each inserted into a bore 49 in terminal element 11 opposite sliding contact surface 21. Pressure springs 48 are supported at base body 23 so that terminal elements 11 are each pressed against contact surface 20 by means of pressure springs 48 using contact force.

Contact element 11 is made of graphite. Grooves 50 extending in the axial direction are formed in terminal element 11 or in sliding contact surface 21. Grooves 50 serve for reducing friction and heat and for deflecting brush dust. A continuous current of up to 250 A can be discharged using ground terminal 10.

The invention claimed is:

1. A ground terminal configured to discharge electric currents from a rotor part of a vehicle having an axle to a stationary stator part of the vehicle, the ground terminal comprising:

a retaining device and a terminal element, the retaining device having a spring device and being connected to the stationary stator part of the vehicle in an electrically-conductive manner, the terminal element having a sliding contact surface and being disposed on the retaining device and connected thereto in an electrically-conductive manner, wherein at least half of material of the terminal element is graphite—and the terminal element is subjected to a contact force by means of the spring device to form an electrically conductive sliding contact between the sliding contact surface and a terminal surface of the rotor part, wherein the terminal element has an arc-shaped cross section at least in sections of the terminal element, an outer surface of the arc-shaped cross section forming the sliding contact surface at least in sections thereof, the sliding contact surface being dimensioned to abut radially against the terminal surface of the rotor part, wherein the retaining device has a stationary base body, and wherein the retaining device comprises a bearing device configured to rotatably bear the base body on a radial inner surface of the rotor part, the bearing device comprising a rolling bearing or a sliding bearing.

2. The ground terminal according to claim 1, wherein the rotor part forms an circular ring-shaped cross section at an axial end of the axle, an inner surface of the circular ring-shaped cross section forming the terminal surface of the rotor part at least in portions thereof.

3. The ground terminal according claim 2, wherein the inner surface is realized by a recess on the axial end of the axle.

4. The ground terminal according to claim 2, wherein the inner surface is formed by a sleeve of the ground terminal, the sleeve being pressed into a recess on the axial end of the axle.

5. The ground terminal according to claim 1, wherein the axle is configured as a hollow shaft.

6. The ground terminal according to claim 1, wherein the terminal element is retained on a terminal element accommodation unit of the retaining device formed on the base body.

7. The ground terminal according to claim 6, wherein the retaining device includes a guiding device configured to movably guide the terminal element on the terminal element accommodation unit in the radial direction.

8. The ground terminal according to claim 6, wherein the terminal element accommodation unit forms a guide groove that extends radially on the base body, the guide groove accommodating and engaging a guide pin disposed on the terminal element or a protrusion formed on the terminal element.

9. The ground terminal according to claim 1, wherein the ground terminal comprises at least two terminal elements that are disposed coaxially on the base body with respect to a rotational axis of the axle.

10. The ground terminal according to claim 1, wherein the retaining device includes a connection device configured to connect the retaining device and the terminal element in an electrically-conductive manner, the connection device being formed by a protrusion of the base body and comprising a connection element by means of which a strand affixed to the terminal element is fastened to the protrusion.

11. The ground terminal according to claim 10, wherein the protrusion forms a distal end of the base body that is dimensioned to be disposed within a recess on an axial end of the axle.

12. The ground terminal according to claim 1, wherein the bearing device comprises a sealing disc that surrounds the base body at least partly, is connected to an axial end of the axle and seals a recess located on the axial end and dimensioned to receive the base body at least in part.

13. The ground terminal according to claim 1, wherein the bearing device comprises a torque support element by means of which the base body is fastened to the stationary stator part.

14. The ground terminal according to claim 13, wherein the torque support is a bar that is fastened to the base body in a torque-proof manner and via which the base body is connected to the stator part in an electrically-conductive manner.

15. The ground terminal according to claim 1, wherein the spring device has at least one spring element configured as at least one of a coil spring, a pressure spring, a leaf spring, a helical spring, and a diaphragm spring, the spring element being disposed on a pressurizing side of the terminal element facing away from the sliding contact surface.

16. A rail vehicle having a ground terminal according to claim 1.

17. A ground terminal configured to discharge electric currents from a rotor part of a vehicle having an axle to a stationary stator part of the vehicle, the ground terminal comprising:

a retaining device and a terminal element, the retaining device having a spring device and being connected to the stationary stator part of the vehicle in an electrically-conductive manner, the terminal element having a sliding contact surface and being disposed on the retaining device and connected thereto in an electrically-conductive manner, wherein at least half of material of the terminal element is graphite—and the terminal element is subjected to a contact force by means of the spring device to form an electrically conductive sliding contact between the sliding contact surface and a terminal surface of the rotor part, wherein the terminal element has an arc-shaped cross section at least in sections of the terminal element, an outer surface of the arc-shaped cross section forming the sliding contact surface at least in sections thereof, the sliding contact surface being dimensioned to abut radially against the terminal surface of the rotor part, wherein the retaining device has a stationary base body, and wherein the retaining device includes a connection device configured to connect the retaining device and the terminal element in an electrically-conductive manner, the connection device being formed by a protrusion of the base body and comprising a connection element by means of which a strand affixed to the terminal element is fastened to the protrusion.

18. A ground terminal configured to discharge electric currents from a rotor part of a vehicle having an axle to a stationary stator part of the vehicle, the ground terminal comprising:

a retaining device and a terminal element, the retaining device having a spring device and being connected to the stationary stator part of the vehicle in an electrically-conductive manner, the terminal element having a sliding contact surface and being disposed on the retaining device and connected thereto in an electrically-conductive manner, wherein at least half of material of the terminal element is graphite and the terminal element is subjected to a contact force by means of the spring device to form an electrically conductive sliding contact between the sliding contact surface and a terminal surface of the rotor part, wherein the terminal element has an arc-shaped cross section at least in sections of the terminal element, an outer surface of the arc-shaped cross section forming the sliding contact surface at least in sections thereof, the sliding contact surface being dimensioned to abut radially against the terminal surface of the rotor part, wherein the retaining device has a stationary base body, wherein the terminal element is retained on a terminal element accommodation unit of the retaining device formed on the base body, and wherein the terminal element accommodation unit forms a guide groove that extends radially on the base body, the guide groove accommodating and engaging a guide pin disposed on the terminal element or a protrusion formed on the terminal element.

* * * * *